US010784575B2

(12) United States Patent
Veysoglu

(10) Patent No.: US 10,784,575 B2
(45) Date of Patent: Sep. 22, 2020

(54) PHASED ANTENNA ARRAY AND METHOD OF THINNING THEREOF

(71) Applicant: The Boeing Company, Chicago, IL (US)

(72) Inventor: Murat E. Veysoglu, Cypress, CA (US)

(73) Assignee: The Boeing Company, Chicago, IL (US)

( * ) Notice: Subject to any disclaimer, the term of this patent is extended or adjusted under 35 U.S.C. 154(b) by 128 days.

(21) Appl. No.: 16/038,319

(22) Filed: Jul. 18, 2018

(65) Prior Publication Data

US 2020/0028256 A1 Jan. 23, 2020

(51) Int. Cl.

| | |
|---|---|
| ***H01Q 1/24*** | (2006.01) |
| ***H01Q 3/24*** | (2006.01) |
| ***H01Q 25/00*** | (2006.01) |
| ***H01Q 25/04*** | (2006.01) |

(52) U.S. Cl.
CPC ..... *H01Q 3/247* (2013.01); *H01Q 25/002* (2013.01); *H01Q 25/005* (2013.01); *H01Q 25/04* (2013.01)

(58) Field of Classification Search
CPC ..... H01Q 1/24; H01Q 3/247; H01Q 25/002; H01Q 25/005; H01Q 25/04
USPC ..... 343/702
See application file for complete search history.

(56) References Cited

U.S. PATENT DOCUMENTS

| | | | | |
|---|---|---|---|---|
| 4,071,848 A | 1/1978 | Leeper | | |
| 4,797,682 A | 1/1989 | Klimczak | | |
| 5,774,690 A | 6/1998 | O'Neill | | |
| 6,885,355 B2 * | 4/2005 | Killen | H01Q 15/02 | 343/700 MS |
| 7,042,393 B1 | 5/2006 | Konapelsky et al. | | |
| 7,348,929 B2 * | 3/2008 | Phelan | H01Q 21/22 | 343/844 |
| 8,054,224 B1 * | 11/2011 | de La Chapelle | H01Q 3/26 | 342/372 |
| 10,431,900 B2 * | 10/2019 | Angeletti | G06F 17/14 | |
| 2015/0333412 A1 * | 11/2015 | Angeletti | H01Q 21/20 | 700/98 |

FOREIGN PATENT DOCUMENTS

WO 2007040635 A1 4/2007

* cited by examiner

*Primary Examiner* — Huedung X Mancuso
(74) *Attorney, Agent, or Firm* — Armstrong Teasdale LLP

(57) ABSTRACT

A method of thinning a phased antenna array including defining a performance characteristic for the phased antenna array, partitioning the phased antenna array to define a plurality of sectors that each include an equal number of radiating element locations, wherein each radiating element location is either an active radiating element location or an inactive radiating element location. The method also includes determining a number of active radiating element locations to be included in a first sector of the plurality of sectors, and determining, based on the number of active radiating element locations, at least one arrangement of active and inactive radiating element locations in the first sector configured to achieve the performance characteristic. The method further includes applying the at least one arrangement to each remaining sector of the plurality of sectors such that the phased antenna array has rotational symmetry.

20 Claims, 6 Drawing Sheets

PHASED ANTENNA ARRAY AND METHOD OF THINNING THEREOF

FIELD

The field of the present disclosure relates generally to phased antenna arrays and, more specifically, to an array thinning method and phased antenna arrays resulting therefrom.

BACKGROUND

Communications systems, such as satellites, sometimes use multi-beam antennas, such as phased antenna arrays, to perform signal processing operations. Phased antenna arrays typically include multiple radiating elements, element and signal control circuits, a signal distribution network, a power supply, and a mechanical support structure. At least some known phased antenna arrays include active radiating elements and inactive radiating elements, with the inactive radiating elements either being physically present in the array but deactivated, or being physically removed from the array. The signal processing operations are performed only by the active radiating elements, and the locations of the active and inactive radiating elements in the array are selected to improve the performance of the array. For example, one known method of selecting the locations of the active and inactive elements in the array is a discrete optimization technique, which evaluates the performance of the array when different element locations in the array are selected to be either active or inactive locations. However, performing the discrete optimization technique for each element location in the array can be a time-consuming task that requires a large amount of computing power.

BRIEF DESCRIPTION

In one aspect, a method of thinning a phased antenna array is provided. The method includes defining a performance characteristic for the phased antenna array, partitioning the phased antenna array to define a plurality of sectors that each include an equal number of radiating element locations, wherein each radiating element location is either an active radiating element location or an inactive radiating element location. The method also includes determining a number of active radiating element locations to be included in a first sector of the plurality of sectors, and determining, based on the number of active radiating element locations, at least one arrangement of active and inactive radiating element locations in the first sector configured to achieve the performance characteristic. The method further includes applying the at least one arrangement to each remaining sector of the plurality of sectors such that the phased antenna array has rotational symmetry.

In another aspect, a phased antenna array is provided. The array includes a plurality of radiating elements partitioned into a plurality of sectors, wherein each sector includes an equal number of radiating elements, and wherein the plurality of radiating elements are arranged to define a plurality of active radiating element locations and a plurality of inactive radiating element locations. Each sector includes the plurality of active radiating element locations and the plurality of inactive radiating element locations defined in a predetermined arrangement such that the phased antenna array has rotational symmetry.

In yet another aspect, a satellite is provided. The satellite includes a beamformer and a phased antenna array in communication with the beamformer. The array includes a plurality of radiating elements partitioned into a plurality of sectors, wherein each sector includes an equal number of radiating elements, and wherein the plurality of radiating elements are arranged to define a plurality of active radiating element locations and a plurality of inactive radiating element locations. Each sector includes the plurality of active radiating element locations and the plurality of inactive radiating element locations defined in a predetermined arrangement such that the phased antenna array has rotational symmetry.

DETAILED DESCRIPTION

The implementations described herein relate to an array thinning method and phased antenna arrays resulting therefrom. More specifically, a phased antenna array is typically designed to include a predetermined amount of radiating element locations, and each location is either an active radiating element location or an inactive radiating element location. The method described herein facilitates determining how to arrange the active and inactive radiating element locations in a manner that facilitates achieving a performance characteristic for the array. For example, the method includes partitioning the array to define a plurality of sectors that each include an equal number of radiating element locations. A combinatorial optimization analysis is performed on a first sector of the plurality of sectors to determine an arrangement of active and inactive radiating element locations that will facilitate achievement of the performance characteristic. Put another way, the combinatorial optimization analysis is performed on a set of radiating element locations that includes less than a total number of radiating element locations in the array. The arrangement in the first sector is then applied to the remaining sectors in the array such that the array has rotational symmetry. As such, applying rotational symmetry to the phased antenna array design facilitates reducing the problem size for the combinatorial optimization analysis, which facilitates reducing an amount of computing power and time required to design the array, and which results in unique array designs that would not typically be realized by other optimization methods.

As used herein, an element or step recited in the singular and proceeded with the word "a" or "an" should be understood as not excluding plural elements or steps, unless such exclusion is explicitly recited. Furthermore, references to "exemplary implementation" or "one implementation" of the present disclosure are not intended to be interpreted as excluding the existence of additional implementations that also incorporate the recited features.

Figure 1:
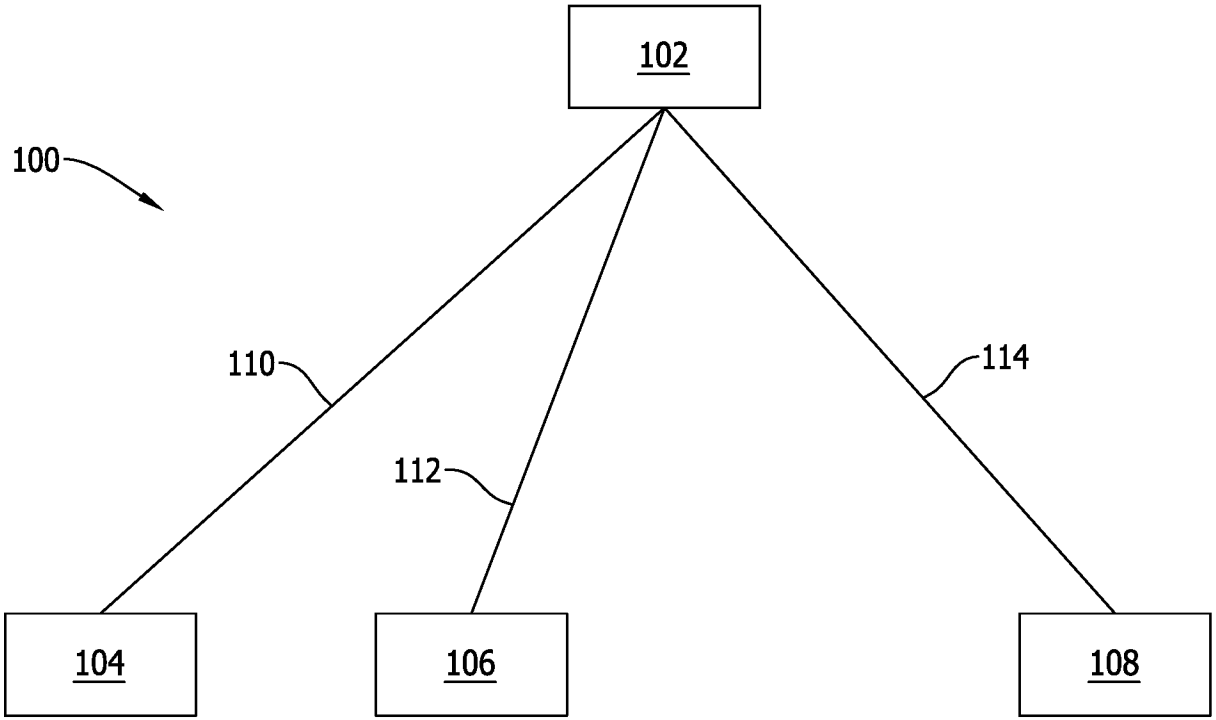
FIG. 1 is a block diagram illustrating an example communications environment.

FIG. 1 is a block diagram illustrating an example communications environment 100 including a satellite 102, a first communications source 104, a second communications source 106, and a third communications source 108. Satellite 102 exchanges communication data with first communications source 104 in a first communications beam 110, with second communications source 106 in a second communications beam 112, and with third communications source 108 in a third communications beam 114. First communications source 104, second communications source 106, and third communications source 108 may be ground-based, air-based, or space-based devices.

Figure 2:
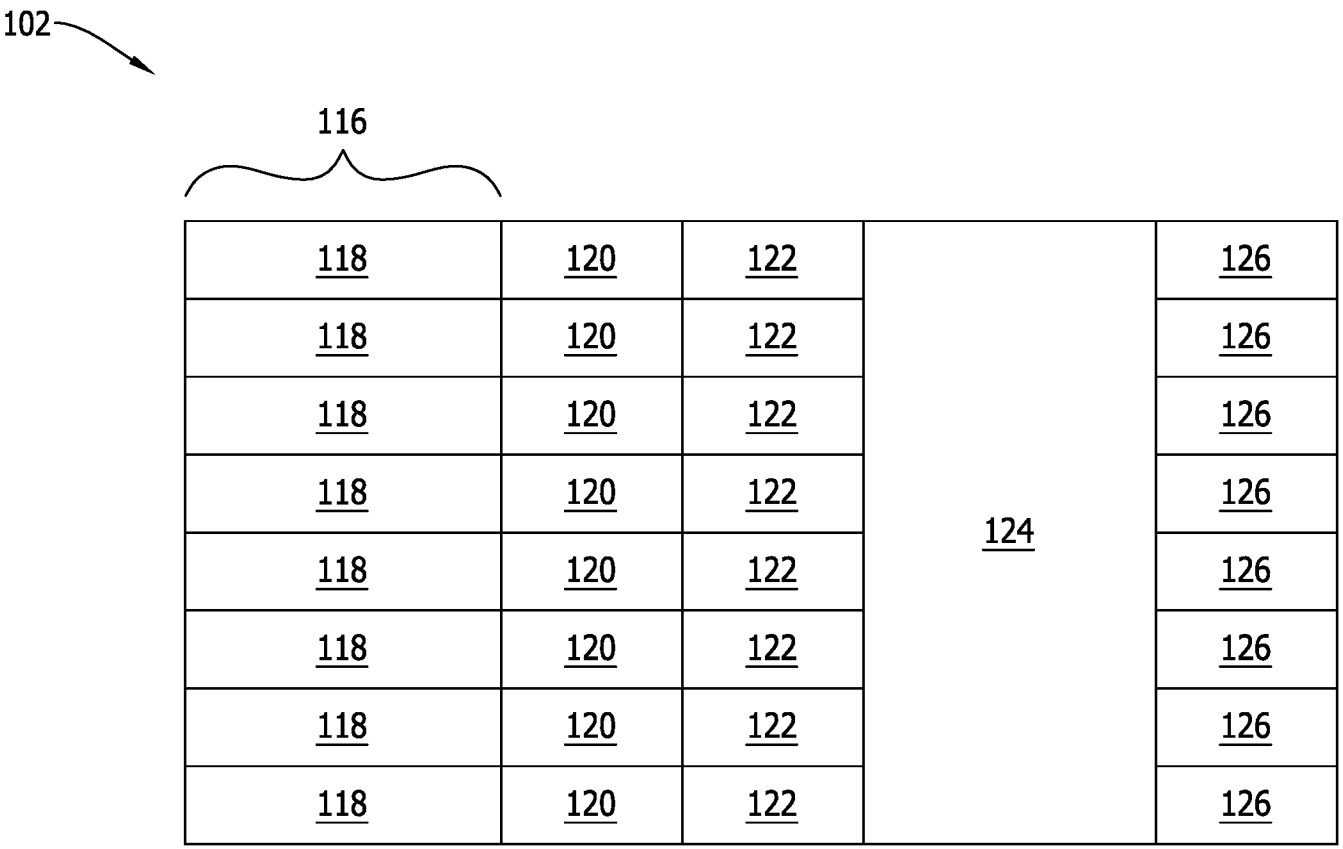
FIG. 2 is a block diagram illustrating an example satellite that may be used in the communications environment shown in FIG. 1.

FIG. 2 is a block diagram illustrating satellite 102. In the example implementation, satellite 102 includes a phased antenna array 116. More specifically, phased antenna array 116 is programmable or adjustable to selectively receive/transmit signals or beams from/to various directions and/or sources. Phased antenna array 116 includes a plurality of radiating elements 118. Radiating elements 118 receive/transmit electromagnetic radiation transmitted from/to one or more sources, such as first communications source 104, second communications source 106, and/or third communications source 108. A plurality of phase shifters 120 and corresponding attenuators 122 are coupled in communication with each radiating element 118. For simplicity of illustration, the number of phase shifters 120 and attenuators 122 shown in FIG. 2 is the same as the number of radiating elements 118. It should be understood, however, that satellite 102 can include more than one phase shifter 120 per radiating element 118. A beamformer 124 (sometimes referred to as a beamforming system, a system configured to perform beamforming, or a system) is coupled in communication with phase shifters 120 and attenuators 122. Beamformer 124 transmits control signals to phase shifters 120 and attenuators 122 to adjust the phase and/or magnitude of received electromagnetic radiation, and forms one or more corresponding beams. Each beam is typically associated with a plurality of radiating elements, a plurality of phase shifters, and a plurality of attenuators. Each beam is received in a corresponding beamport 126, which is included in or coupled to beamformer 124.

Figure 3:
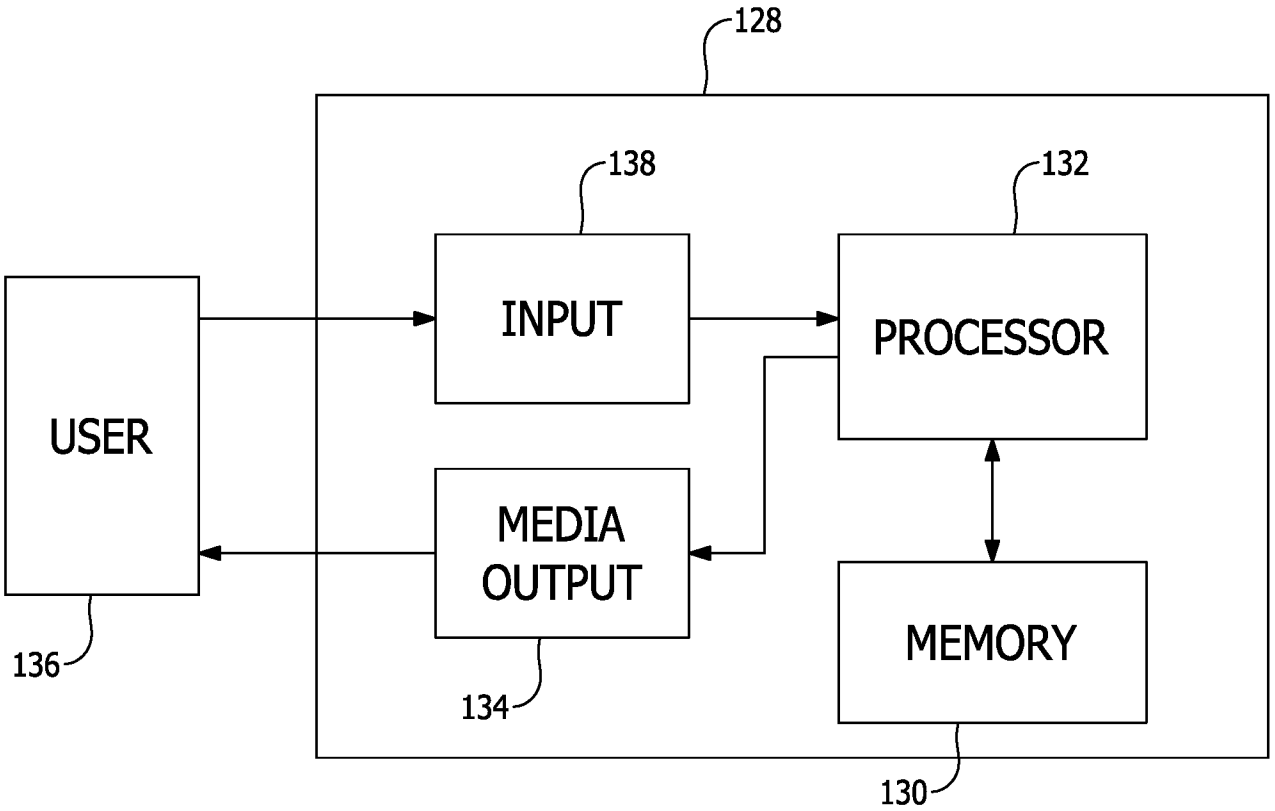
FIG. 3 is an illustration of an example computing device that may be used to design and thin a phased antenna array of the satellite shown in FIG. 2.

FIG. 3 is an illustration of an example computing device 128 that may be used to design and thin phased antenna array 116 (shown in FIG. 2). In the example implementation, computing device 128 includes a memory 130 and a processor 132, including hardware and software, coupled to memory 130 for executing programmed instructions. Processor 132 may include one or more processing units (e.g., in a multi-core configuration) and/or include a cryptographic accelerator (not shown). Computing device 128 is programmable to perform one or more operations described herein by programming memory 130 and/or processor 132. For example, processor 132 may be programmed by encoding an operation as executable instructions and providing the executable instructions in memory 130.

Processor 132 may include, but is not limited to, a general purpose central processing unit (CPU), a microcontroller, a microprocessor, a reduced instruction set computer (RISC) processor, an open media application platform (OMAP), an application specific integrated circuit (ASIC), a programmable logic circuit (PLC), and/or any other circuit or processor capable of executing the functions described herein. The methods described herein may be encoded as executable instructions embodied in a computer-readable medium including, without limitation, a storage device and/or a memory device. Such instructions, when executed by processor 132, cause processor 132 to perform at least a portion of the functions described herein. The above examples are exemplary only, and thus are not intended to limit in any way the definition and/or meaning of the term processor.

Computing device 128 also includes at least one media output component 134 for presenting information to a user 136. Media output component 134 is any component capable of conveying information to a user 136. In some implementations, media output component 134 includes an output adapter such as a video adapter and/or an audio adapter. An output adapter is operatively coupled to processor 132 and operatively couplable to an output device such as a display device (e.g., a liquid crystal display (LCD), organic light emitting diode (OLED) display, cathode ray tube (CRT), or "electronic ink" display) or an audio output device (e.g., a speaker or headphones).

In some implementations, computing device 128 includes an input device 138 for receiving input from user 136. Input device 138 may include, for example, a keyboard, a pointing device, a mouse, a stylus, a touch sensitive panel (e.g., a touch pad or a touch screen), a gyroscope, an accelerometer, a position detector, or an audio input device. A single component such as a touch screen may function as both an output device of media output component 134 and input device 138.

Figure 4:
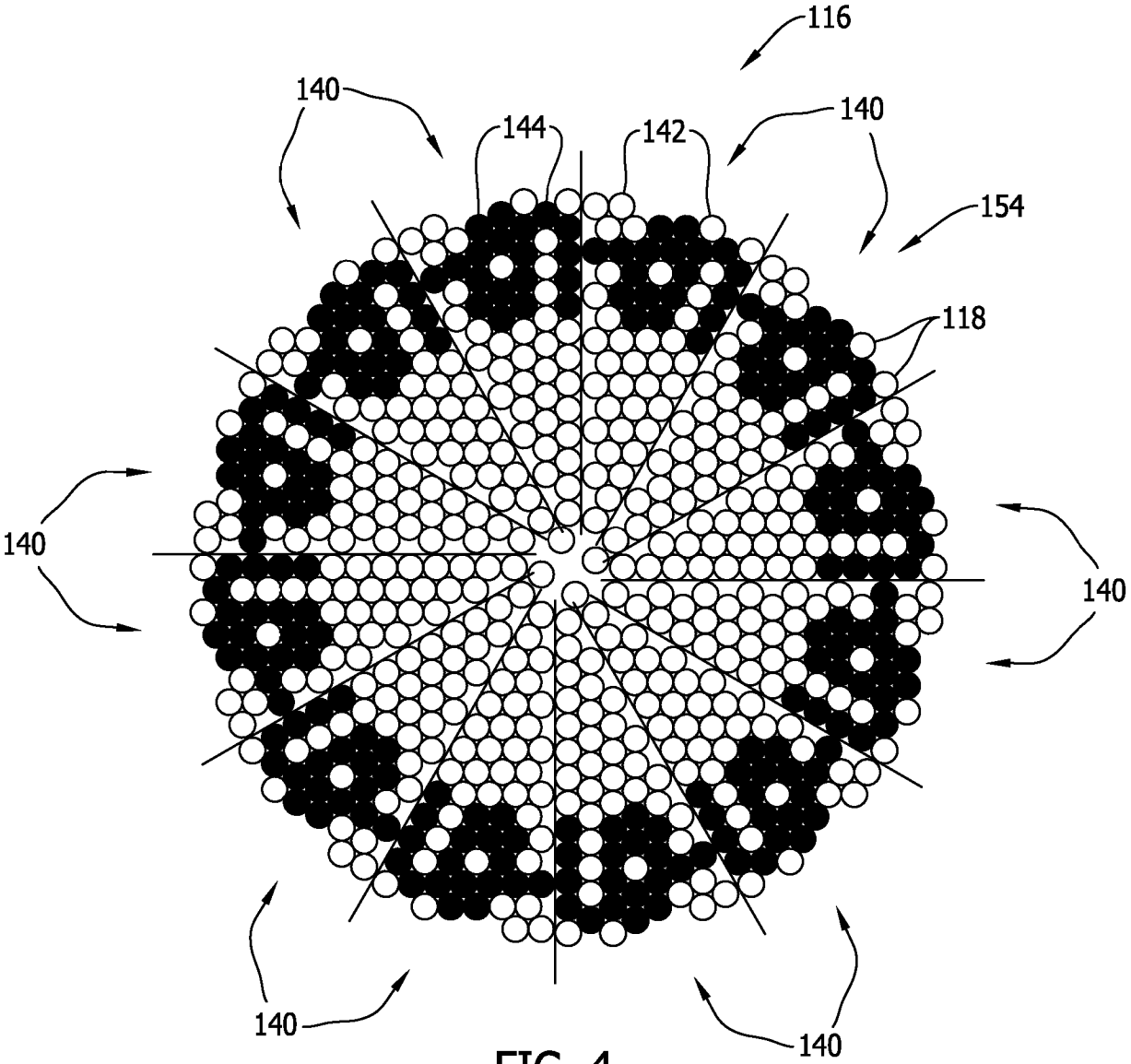
FIG. 4 is an illustration of an example phased antenna array that may be used in the satellite shown in FIG. 2.

Computing device 128 is programmable to perform a method of thinning phased antenna array 116 (shown in FIG. 2). As used herein, "thinning" refers to a process of selectively removing radiating elements from a phased antenna array design such that a resulting phased antenna array includes a number of active radiating elements that is less than a total number of radiating element locations in the array. The removed radiating elements may be either selectively deactivated radiating elements or selectively omitted radiating elements. For example, referring to FIG. 4, phased antenna array 116 includes a plurality of radiating elements 118 partitioned into a plurality of sectors 140. Each sector 140 includes an equal number of radiating elements 118 and radiating element locations. Radiating elements 118 are arranged to define a plurality of active radiating element locations 142 and a plurality of inactive radiating element locations 144. In one implementation, phased antenna array 116 includes a full complement of radiating elements 118 in the radiating element locations (i.e., the combination of active radiating element locations 142 and inactive radiating element locations 144), but radiating elements 118 positioned in inactive radiating element locations 144 are selectively deactivatable during operation of phased antenna array 116. Alternatively, radiating elements 118 are selectively omitted (i.e., physically removed) from phased antenna array 116 in inactive radiating element locations 144.

In operation, computing device 128 receives at least one input from user 136 via input device 138 (all shown in FIG. 3), and the at least one input is used to determine which radiating elements 118 to selectively remove from phased antenna array 116. In other words, computing device 128 facilitates determining an arrangement of active and inactive radiating element locations 142 and 144 that will result in achievement of a performance characteristic for phased antenna array 116, as will be explained in more detail below. In the example implementation, computing device 128 receives inputs such as, but not limited to, a total number of radiating elements locations to be included in phased antenna array 116, a number of active radiating elements and inactive radiating elements to be included in phased antenna array 116, a performance characteristic for phased antenna array 116, and a number of sectors 140 included in, and in which to partition, phased antenna array 116.

The total number of radiating elements locations and the number of active and inactive radiating elements are values that are design parameters instituted at the outset of the design phase of phased antenna array 116. The values of each design parameter may be dictated as a function of cost to make phased antenna array 116, for example, and are utilized as constraints for computing device 128 when performing the combinatorial optimization analysis.

Phased antenna array 116 may include any number of sectors 140 that enables the systems and methods to function as described herein. The selection of the number of sectors 140 to include in phased antenna array 116 is determined as a function of computing power required to perform the combinatorial optimization analysis for a given number of radiating elements 118 in a sector. For example, the greater the number of radiating elements 118 in a sector, the greater the number of possible solutions to the optimization problem, and the greater amount of computing power required to perform the analysis. Therefore, the number of sectors is selected to bound the computation complexity without over-constraining the optimization due to the imposed symmetry.

Figure 5:
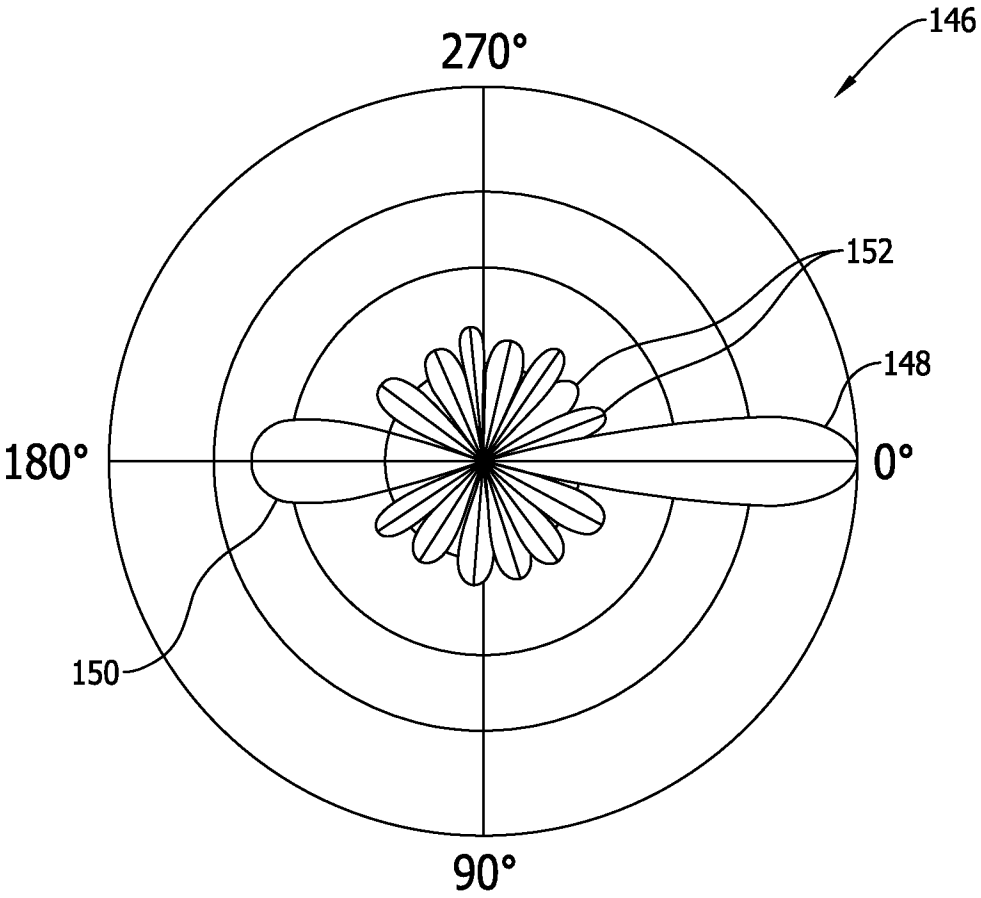
FIG. 5 is an illustration of an example radiation pattern emitted by the phased antenna array shown in FIG. 4.

Referring to FIG. 5, phased antenna array 116 (shown in FIG. 4) has a coverage region 146 including a main lobe region 148, a back lobe region 150, and a plurality of side lobe regions 152. In the example implementation, the performance characteristic input by user 136, and then defined by computing device 128 (both shown in FIG. 3), is a side lobe profile for coverage region 146 of phased antenna array 116. For example, user 136 may input a side lobe objective (e.g., suppress the side lobe level of radiation in a region, or regions, by a certain amount) into computing device 128. Thus, the user input may be used to define a side lobe level of radiation to be emitted from each side lobe region 152 of phased antenna array 116 that is less than a threshold.

Referring again to FIGS. 3 and 4, computing device 128 is capable of determining at least one arrangement of active and inactive radiating element locations 142 and 144 in a first sector 154 of the plurality of sectors 140 once the user inputs are received. First sector 154, and each sector 140, includes a fraction of the total number of radiating element locations in phased antenna array 116. Thus, determining the at least one arrangement for first sector 154 facilitates reducing the problem size to be solved by the combinatorial optimization analysis. For example, once the user inputs are received, computing device 128 determines a number of active radiating element locations 142 to be included in first sector 154. The number of active radiating element locations 142 is determined by determining a total number of active radiating element locations 142 to be included in phased antenna array 116, and determining a fraction of the total number of active radiating element locations 142. The fraction used to determine the number of active radiating element locations 142 to include in first sector 154 is based on, and corresponds to, the number of sectors 140 in phased antenna array 116.

For example, phased antenna array 116 may be constrained to include 720 total radiating element locations, and to include 480 active radiating element locations 142. In one implementation, phased antenna array 116 includes twelve sectors 140 that each define a 30° segment of phased antenna array 116. Thus, first sector 154 is designed to include 60 total radiating element locations, 40 active radiating element locations 142, and 20 inactive radiating element locations 144, which are each $1/12^{th}$ of the respective radiating element location values.

Computing device 128 then determines, based on the number of active radiating element locations 142, at least one arrangement of active and inactive radiating element locations 142 and 144 in first sector 154 configured to achieve the performance characteristic for phased antenna array 116. For example, in one implementation, computing device 128 performs the combinatorial optimization analysis to determine an arrangement of active and inactive radiating element locations 142 and 144 that will result in the level of radiation for each side lobe region 152 (shown in FIG. 5) being less than the threshold. The arrangement is then applied to each remaining sector 140 of the plurality of sectors 140 such that phased antenna array 116 has rotational symmetry. That is, the arrangement defines a predetermined pattern of active and inactive radiating element locations 142 and 144, and the arrangement is applied by configuring the remaining sectors to include the same predetermined pattern. Thus, a phased antenna array design is formed having comparable performance characteristics relative to an array formed by performing a combinatorial optimization analysis on the whole array of radiating elements.

In some implementations, computing device 128 determines at least a first arrangement and a second arrangement of active and inactive radiating element locations. The active radiating element locations 142 and the inactive radiating element locations 144 are organized differently in the first arrangement and the second arrangement. Thus, in implementations where radiating elements 118 are selectively deactivated radiating elements, more than one arrangement is available for phased antenna array 116 to be operated. As such, phased antenna array 116 is selectively operable between the first arrangement and the second arrangement in the event one or more radiating elements 118 malfunction, for example.

Figure 6:
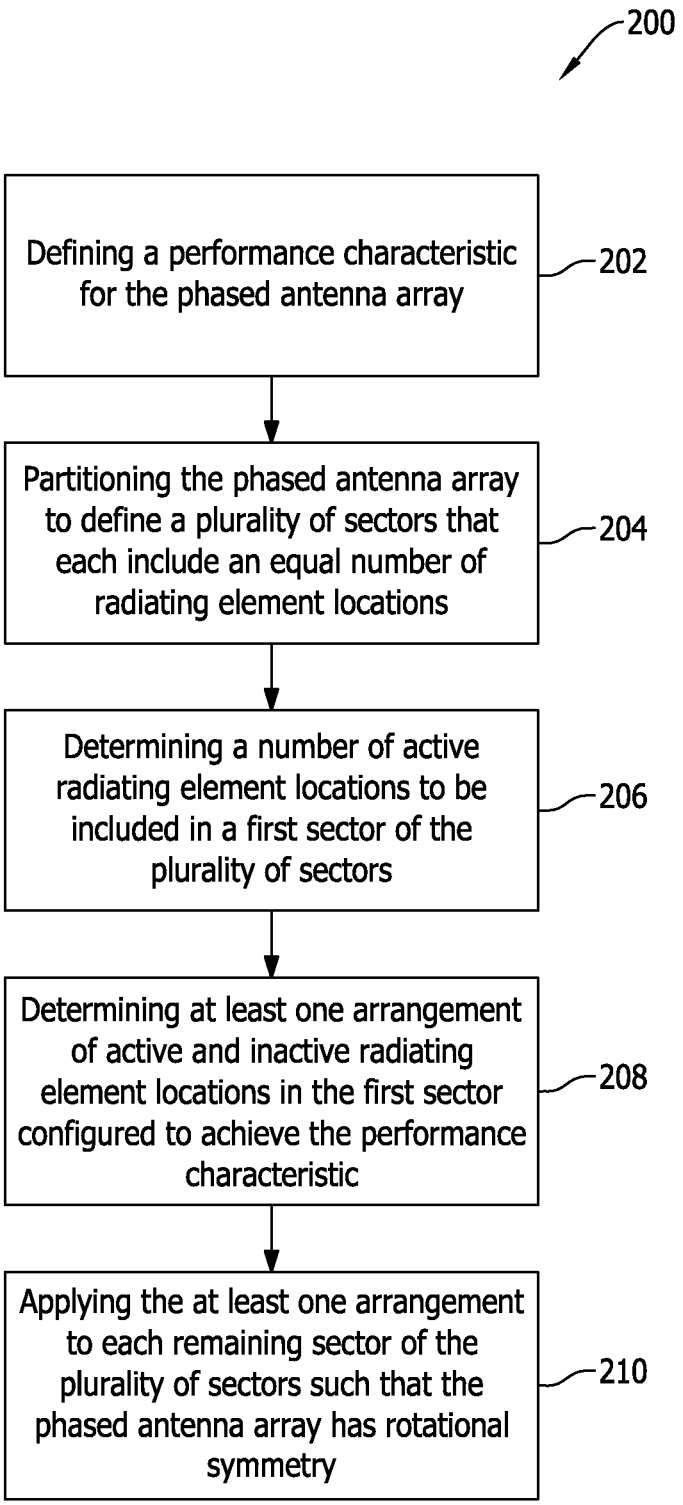
FIG. 6 is a flow diagram illustrating an example method of thinning a phased antenna array.

FIG. 6 is a flow diagram illustrating an example method 200 of thinning a phased antenna array. The method 200 includes defining 202 a performance characteristic for the phased antenna array, partitioning 204 the phased antenna array to define a plurality of sectors that each include an equal number of radiating element locations, wherein each radiating element location is either an active radiating element location or an inactive radiating element location, determining 206 a number of active radiating element locations to be included in a first sector of the plurality of sectors, determining 208, based on the number of active radiating element locations, at least one arrangement of active and inactive radiating element locations in the first sector configured to achieve the performance characteristic, and applying 210 the at least one arrangement to each remaining sector of the plurality of sectors such that the phased antenna array has rotational symmetry.

This written description uses examples to disclose various implementations, including the best mode, and also to enable any person skilled in the art to practice the various implementations, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of thinning a phased antenna array, the method comprising:

defining a performance characteristic for the phased antenna array;

partitioning the phased antenna array to define a plurality of sectors that each include an equal number of radiating element locations, wherein each radiating element location is either an active radiating element location or an inactive radiating element location;

determining a number of active radiating element locations to be included in a first sector of the plurality of sectors;

determining, based on the number of active radiating element locations, at least one arrangement of active and inactive radiating element locations in the first sector configured to achieve the performance characteristic; and applying the at least one arrangement to each remaining sector of the plurality of sectors such that the phased antenna array has rotational symmetry.

2. The method in accordance with claim 1 further comprising determining a number of inactive radiating element locations to be included in the first sector of the plurality of sectors, wherein radiating elements in the inactive radiating element locations are selectively deactivated radiating elements.

3. The method in accordance with claim 1 further comprising determining a number of inactive radiating element locations to be included in the first sector of the plurality of sectors, wherein radiating elements are selectively omitted from the phased antenna array in the inactive radiating element locations.

4. The method in accordance with claim 1, wherein determining a number of active radiating element locations to be included in the first sector comprises:

determining a total number of active radiating element locations to be included in the phased antenna array; and determining a fraction of the total number of active radiating element locations, wherein the fraction is based on a number of the plurality of sectors in the phased antenna array.

5. The method in accordance with claim 1, wherein determining at least one arrangement of active and inactive radiating element locations comprises determining a first arrangement and a second arrangement of active and inactive radiating element locations, the active radiating element locations and the inactive radiating element locations organized differently in the first arrangement and the second arrangement.

6. The method in accordance with claim 1, wherein determining at least one arrangement comprises performing a combinatorial optimization analysis.

7. The method in accordance with claim 1, wherein defining a performance characteristic comprises defining a side lobe profile for a coverage region of the phased antenna array.

8. The method in accordance with claim 7, wherein the coverage region includes a main lobe region and a plurality of side lobe regions, wherein defining a side lobe profile comprises defining a side lobe level of radiation to be emitted from each side lobe region of the phased antenna array that is less than a threshold.

9. A phased antenna array comprising:

a plurality of radiating elements partitioned into a plurality of sectors, wherein each sector includes an equal number of radiating elements, and wherein the plurality of radiating elements are arranged to define a plurality of active radiating element locations and a plurality of inactive radiating element locations, wherein each sector includes the plurality of active radiating element locations and the plurality of inactive radiating element locations defined in a predetermined arrangement such that the phased antenna array has rotational symmetry.

10. The phased antenna array in accordance with claim 9, wherein the plurality of inactive radiating element locations include selectively deactivated radiating elements positioned therein.

11. The phased antenna array in accordance with claim 9, wherein the plurality of inactive radiating element locations include selectively omitted radiating elements.

12. The phased antenna array in accordance with claim 9, wherein the predetermined arrangement of active and inactive radiating element locations is organized to achieve a performance characteristic for the phased antenna array.

13. The phased antenna array in accordance with claim 12, wherein the predetermined arrangement of active and inactive radiating element locations is organized to define a predetermined side lobe profile for a coverage region of the phased antenna array.

14. The phased antenna array in accordance with claim 13, wherein the coverage region includes a main lobe region and a plurality of side lobe regions, wherein the predetermined arrangement of active and inactive radiating element locations is organized to define a side lobe level of radiation to be emitted from each side lobe region of the phased antenna array that is less than a threshold.

15. A satellite comprising:

a beamformer; and a phased antenna array in communication with said beamformer, said phased antenna array comprising a plurality of radiating elements partitioned into a plurality of sectors, wherein each sector includes an equal number of radiating elements, and wherein the plurality of radiating elements are arranged to define a plurality of active radiating element locations and a plurality of inactive radiating element locations, wherein each sector includes the plurality of active radiating element locations and the plurality of inactive radiating element locations defined in a predetermined arrangement such that the phased antenna array has rotational symmetry.

16. The satellite in accordance with claim 15, wherein the plurality of inactive radiating element locations include selectively deactivated radiating elements positioned therein.

17. The satellite in accordance with claim 15, wherein the plurality of inactive radiating element locations include selectively omitted radiating elements.

18. The satellite in accordance with claim 15, wherein the predetermined arrangement of active and inactive radiating element locations is organized to achieve a performance characteristic for the phased antenna array.

19. The satellite in accordance with claim 18, wherein the predetermined arrangement of active and inactive radiating element locations is organized to define a predetermined side lobe profile for a coverage region of the phased antenna array.

20. The satellite in accordance with claim 19, wherein the coverage region includes a main lobe region and a plurality of side lobe regions, wherein the predetermined arrangement of active and inactive radiating element locations is organized to define a side lobe level of radiation to be emitted from each side lobe region of the phased antenna array that is less than a threshold.

* * * * *